US010584721B2

(12) United States Patent
Kerth

(10) Patent No.: US 10,584,721 B2
(45) Date of Patent: Mar. 10, 2020

(54) METHOD OF CONSTRUCTION FOR INTERNALLY COOLED DIAPHRAGMS FOR CENTRIFUGAL COMPRESSOR

(71) Applicant: Jason M. Kerth, Houston, TX (US)

(72) Inventor: Jason M. Kerth, Houston, TX (US)

(73) Assignee: DRESSER-RAND COMPANY, Olean, NY (US)

( * ) Notice: Subject to any disclaimer, the term of this patent is extended or adjusted under 35 U.S.C. 154(b) by 190 days.

(21) Appl. No.: 14/190,931

(22) Filed: Feb. 26, 2014

(65) Prior Publication Data

US 2018/0291927 A1 Oct. 11, 2018

Related U.S. Application Data

(60) Provisional application No. 61/770,240, filed on Feb. 27, 2013.

(51) Int. Cl.

| | |
|---|---|
| ***F04D 17/10*** | (2006.01) |
| ***F04D 29/58*** | (2006.01) |
| ***F04D 29/44*** | (2006.01) |
| ***F04D 17/12*** | (2006.01) |

(52) U.S. Cl.

CPC ..... *F04D 29/5833* (2013.01); *F04D 17/122* (2013.01); *F04D 29/444* (2013.01); *F04D 29/584* (2013.01); *F04D 17/10* (2013.01)

(58) Field of Classification Search

None

See application file for complete search history.

(56) References Cited

U.S. PATENT DOCUMENTS

| | | | | |
|---|---|---|---|---|
| 2007/0183892 | A1* | 8/2007 | Sorokes | F04D 17/125 415/214.1 |
| 2010/0089095 | A1 | 4/2010 | Macri et al. | |
| 2012/0063882 | A1* | 3/2012 | Moore | F04D 17/122 415/1 |
| 2014/0030114 | A1* | 1/2014 | Gilarranz | F04D 29/051 417/53 |

(Continued)

FOREIGN PATENT DOCUMENTS

| | | | |
|---|---|---|---|
| DE | 1093040 | A | 11/1955 |
| GB | 105748 | A | 7/1917 |
| JP | S56162298 | A | 12/1981 |

(Continued)

*Primary Examiner* — Michael Lebentritt

(57) ABSTRACT

An internally-cooled compressor is provided including a casing and a diaphragm disposed in the casing. The diaphragm includes a diaphragm box defining a plurality of box channels and a bulb defining a plurality of bulb channels. A plurality of return channel vanes connect the diaphragm box and bulb in fluid communication, such that each return channel vane defines a plurality of return vane conduits coupled in fluid communication with the plurality of box channels and the plurality of bulb channels thereby forming a section of a cooling pathway. The cooling pathway is configured such that a cooling agent introduced from an external coolant source into the diaphragm box and flowing through a box channel flows through a return vane conduit into and through a bulb channel and back through another return vane conduit into another box channel before flowing back to the external coolant source.

19 Claims, 13 Drawing Sheets

(56) References Cited

U.S. PATENT DOCUMENTS

2015/0354379 A1* 12/2015 Miner ..... B23K 20/021
228/193

FOREIGN PATENT DOCUMENTS

| | | | |
|---|---|---|---|
| JP | S62141522 | U | 9/1987 |
| JP | S6446498 | U | 3/1989 |
| JP | H06294398 | A | 10/1994 |

* cited by examiner

METHOD OF CONSTRUCTION FOR INTERNALLY COOLED DIAPHRAGMS FOR CENTRIFUGAL COMPRESSOR

STATEMENT REGARDING FEDERALLY SPONSORED RESEARCH OR DEVELOPMENT

This invention may have been made with government support under DE-FC26-05NT42650 awarded by the United States Department of Energy. The government may have certain rights in the invention.

CROSS REFERENCE TO RELATED APPLICATIONS

This application claims priority to U.S. Provisional Patent Application having Ser. No. 61/770,240, which was filed Feb. 27, 2013. This priority application is hereby incorporated by reference in its entirety into the present application to the extent consistent with the present application.

BACKGROUND

Compressors are employed to increase the pressure of a gas in a variety of different applications and industries. Increasing the pressure of a gas through compression increases the temperature of the gas concurrently. Thus, in a single stage compressor, the temperature of a gas at the discharge of the compressor may be considerably greater than the temperature of the gas at the inlet of the compressor. For compressors including multiple stages, the second and following compressor stages require increasingly more work input per unit pressure increase on account of the elevated temperature of the gas handled by these later stages.

To address the elevated temperatures in multistage compressors, one approach pursued in the art has been the implementation of isothermal compression. Isothermal compression allows for a substantially constant temperature during the gas compression process, which, in turn, reduces the compression power needed. This may be accomplished by removing thermal energy, or heat, at the same rate that it is added by the mechanical work of compression. In practice, interstage coolers have been used to cool the gas between compressor stages. A common design employed in interstage coolers utilizes an external heat exchanger through which the gas is passed as it flows from a first compressor stage to a second compressor stage.

However, the use of interstage coolers typically increases the size and complexity of the compression system. Generally, interstage coolers require additional equipment, for example, heat exchangers and related piping, which may require additional space, especially in compression systems having multiple stages. Furthermore, such additional equipment adds additional expense and requires more frequent and extensive maintenance, resulting in a need for an increased budget for the building and maintenance of the compression system infrastructure.

What is needed, then, is an efficient, reliable, and compact cooling system for a compressor that is capable of transferring heat from the compressed gas to reduce the amount of work input required per unit pressure.

SUMMARY

Embodiments of the disclosure may provide an internally-cooled compressor. The internally-cooled compressor may include a casing defining at least in part a stage inlet and a stage outlet, and a diaphragm disposed in the casing. The diaphragm may include a diaphragm box formed from a plurality of box components, such that one or more of the plurality of box components defines a plurality of box channels. The diaphragm may also include a bulb formed from a plurality of bulb components, such that one or more of the plurality of bulb components defines a plurality of bulb channels. The diaphragm may further include a plurality of return channel vanes connecting the diaphragm box and bulb in fluid communication, such that each of the plurality of return channel vanes defines a plurality of return vane conduits coupled in fluid communication with the plurality of box channels and the plurality of bulb channels, thereby forming a first section of a cooling pathway. The cooling pathway may be configured such that a cooling agent introduced from an external coolant source into the diaphragm box and flowing through a first box channel flows through a first return vane conduit into and through a first bulb channel and back through a second return vane conduit into a second box channel before flowing back to the external coolant source.

Embodiments of the disclosure may further provide a method for cooling a working fluid in a compressor. The method may include feeding the working fluid into an inlet stage of the compressor. The compressor may include a casing defining at least in part the stage inlet and a stage outlet, and a diaphragm disposed in the casing. The diaphragm may include a diaphragm box formed from a plurality of box components, such that one or more of the plurality of box components defines a plurality of box channels. The diaphragm may also include a bulb formed from a plurality of bulb components, such that one or more of the plurality of bulb components defines a plurality of bulb channels. The diaphragm may further include a plurality of return channel vanes connecting the diaphragm box and bulb in fluid communication, such that each of the plurality of return channel vanes defines a plurality of return vane conduits coupled in fluid communication with the plurality of box channels and the plurality of bulb channels, thereby forming a first section of a cooling pathway. The method may also include feeding a cooling agent from an external coolant source into the diaphragm, such that the cooling agent flows through a first box channel and through a first return vane conduit into and through a first bulb channel and back through a second return vane conduit into a second box channel, such that heat is transferred between the working fluid and the cooling agent. The method may further include feeding the cooling agent back to the external coolant source, and feeding the working fluid through the stage outlet for further processing.

Embodiments of the disclosure may further provide a method for manufacturing at least one section of a diaphragm for an internally-cooled compressor. The method may include forming a plurality of bulb components, such that the plurality of bulb components may include a first bulb component forming a plurality of return channel vanes. The method may also include forming a plurality of diaphragm box components, such that the plurality of diaphragm box components may include a first diaphragm box component defining a plurality of first diaphragm box component openings. Each first diaphragm box component opening may be configured and arranged to be substantially aligned with a respective one of a plurality of return channel vane conduits defined by each of the plurality of return channel vanes. The method may further include defining a plurality of box channels in one or more of the plurality of diaphragm box components, and defining a plurality of bulb channels in one or more of the plurality of bulb components. The method may also include interposing a brazing material between each of the plurality of diaphragm box components, each of the plurality of bulb components, and between the bulb component forming the plurality of return channel vanes and the first diaphragm box component forming the plurality of first diaphragm box component openings. The method may further include heating the brazing material and the plurality of diaphragm box components and bulb components in a heating device, and cooling the brazing material and the plurality of diaphragm box components and bulb components, such that the plurality of diaphragm box components and bulb components are joined together to form the at least one section of the diaphragm of the internally-cooled compressor.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
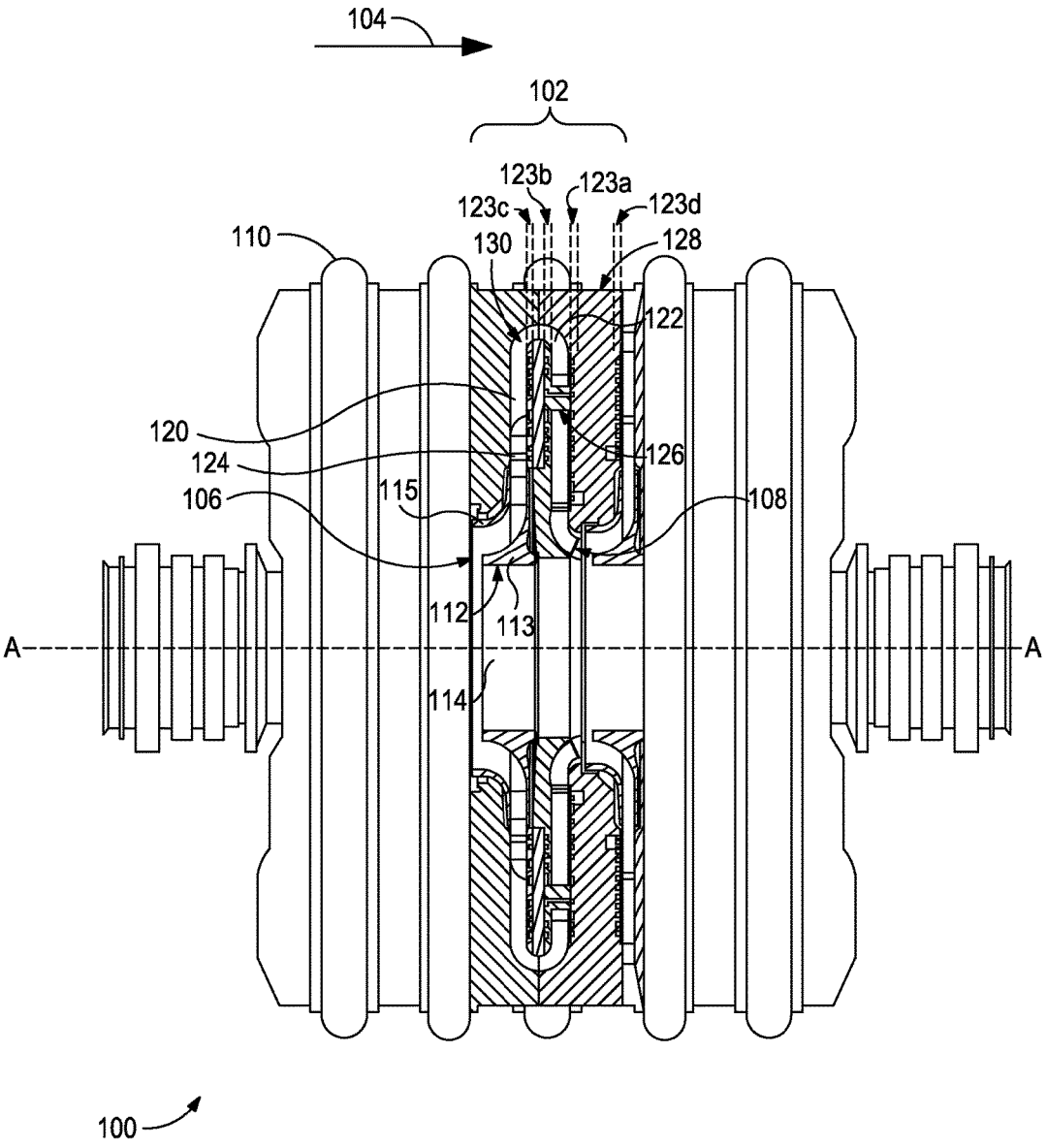
FIG. 1 illustrates a cross-sectional view of an exemplary centrifugal compressor including an internally-cooled diaphragm, according to an embodiment.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
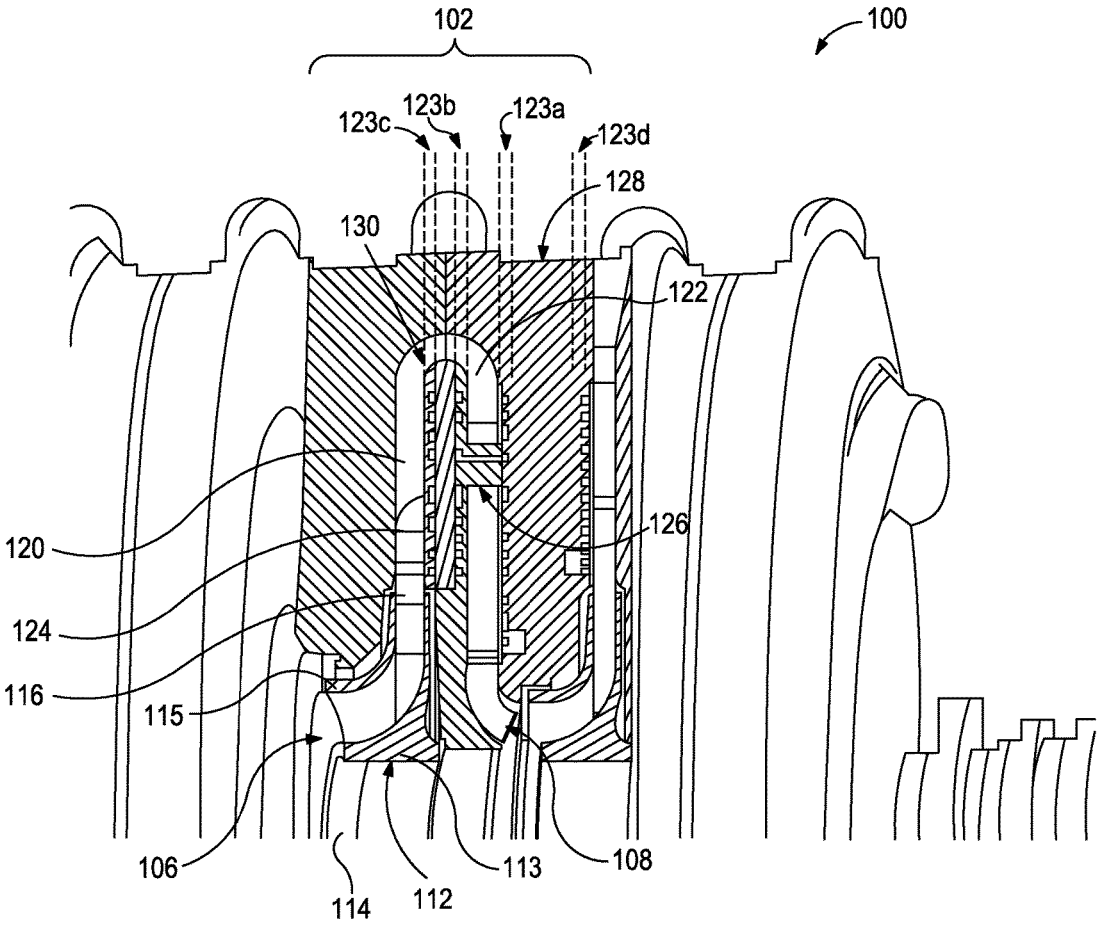
FIG. 2 illustrates an enlarged, partial cross-sectional view of a section of the centrifugal compressor of FIG. 1 including the internally-cooled diaphragm.

FIGS. 1 and 2 illustrate a centrifugal compressor 100 having internally-cooled components, according to an embodiment. For simplicity, a single stage of the centrifugal compressor 100 is illustrated and described below; however, it will be understood by one of ordinary skill in the art that the centrifugal compressor 100 may be utilized in a multi-stage configuration, in which substantially similar compression stages are in fluid communication such that each stage may provide a cooler gas to a subsequent downstream stage.

It will be appreciated by those of ordinary skill in the art that the centrifugal compressor 100 may be used in a multitude of applications, including but not limited to, the compression of $CO_2$ associated with carbon capture and sequestration projects and other similar attempts to reduce emissions while conserving energy. The centrifugal compressor 100 may also be used to compress any other working fluid, such as methane, natural gas, air, oxygen, nitrogen, hydrogen, or any other desired gas. In an exemplary embodiment, the centrifugal compressor 100 may provide significant reduction in the required driver power associated with compression of the working fluid or gas, including $CO_2$. Thus, the centrifugal compressor 100 may reduce the need for interstage coolers.

In an exemplary embodiment, the gas may flow through the centrifugal compressor 100 generally in the direction of arrow 104 from a stage inlet 106 to a stage outlet 108. The stage inlet 106 may be coupled to a pipe configured to flow the gas therethrough from a gas source (not shown) such that the gas source may be in fluid communication with the centrifugal compressor 100 having a compressor casing 110 and associated compressor components therein. The stage outlet 108 may be coupled to one or more downstream components (not shown) via piping such that the centrifugal compressor 100 and the downstream components may be in fluid communication such that gas flowing through the centrifugal compressor 100 may be routed to the downstream components for further processing of the pressurized gas.

The centrifugal compressor 100 may include an impeller 112 configured to rotate within the compressor casing 110. In an exemplary embodiment, the impeller 112 includes a hub 113 and a shroud 115 and may be operatively coupled to a rotary shaft 114 such that the rotary shaft 114 when acted upon by a rotational power source (not shown) rotates, thereby causing the impeller 112 to rotate such that gas flowing into the stage inlet 106 is drawn into the impeller 112 and urged to a tip 116 of the impeller 112, thereby increasing the velocity of the gas. The centrifugal compressor 100 may also include a diaphragm 102 including all of the various components contained within the back half or downstream end of the compressor casing 110. The diaphragm 102 may form at least in part the gas flow path of the centrifugal compressor 100.

In an exemplary embodiment, the diaphragm 102 includes a diffuser 120 proximate to the tip 116 of the impeller 112 and in fluid communication therewith. The diffuser 120 is configured to convert the velocity of the gas received from the impeller 112 to pressure energy, thereby resulting in the compression of the gas. The diaphragm 102 further includes a return channel 122 in fluid communication with the diffuser 120 and configured to receive the compressed gas from the diffuser 120 and eject the compressed gas from the gas flow path via the stage outlet 108, or otherwise injects the compressed gas into a succeeding compressor stage (not shown).

The diaphragm 102 may further include a plurality of diffuser vanes 124 arranged within the diffuser 120 and a plurality of return channel vanes 126 arranged within the return channel 122. Moreover, in an exemplary embodiment, the diaphragm 102 of the centrifugal compressor 100 includes a gas side and a coolant side. The gas side may refer to the gas flow path of the centrifugal compressor 100, including the gas flow through the diffuser 120 and return channel 122, whereas the coolant side may refer to a cooling pathway through which a cooling agent may flow in the diaphragm and may further be defined by the diaphragm 102 and located proximate to the return channel 122 and the diffuser 120 of the gas side. The diaphragm 102 may include a diaphragm box 128 defining a portion of the cooling pathway and the gas flow path, and the diaphragm 102 may further include a bulb 130 configured to define at least a portion of the gas flow path and a portion of the cooling pathway.

Figure 3:
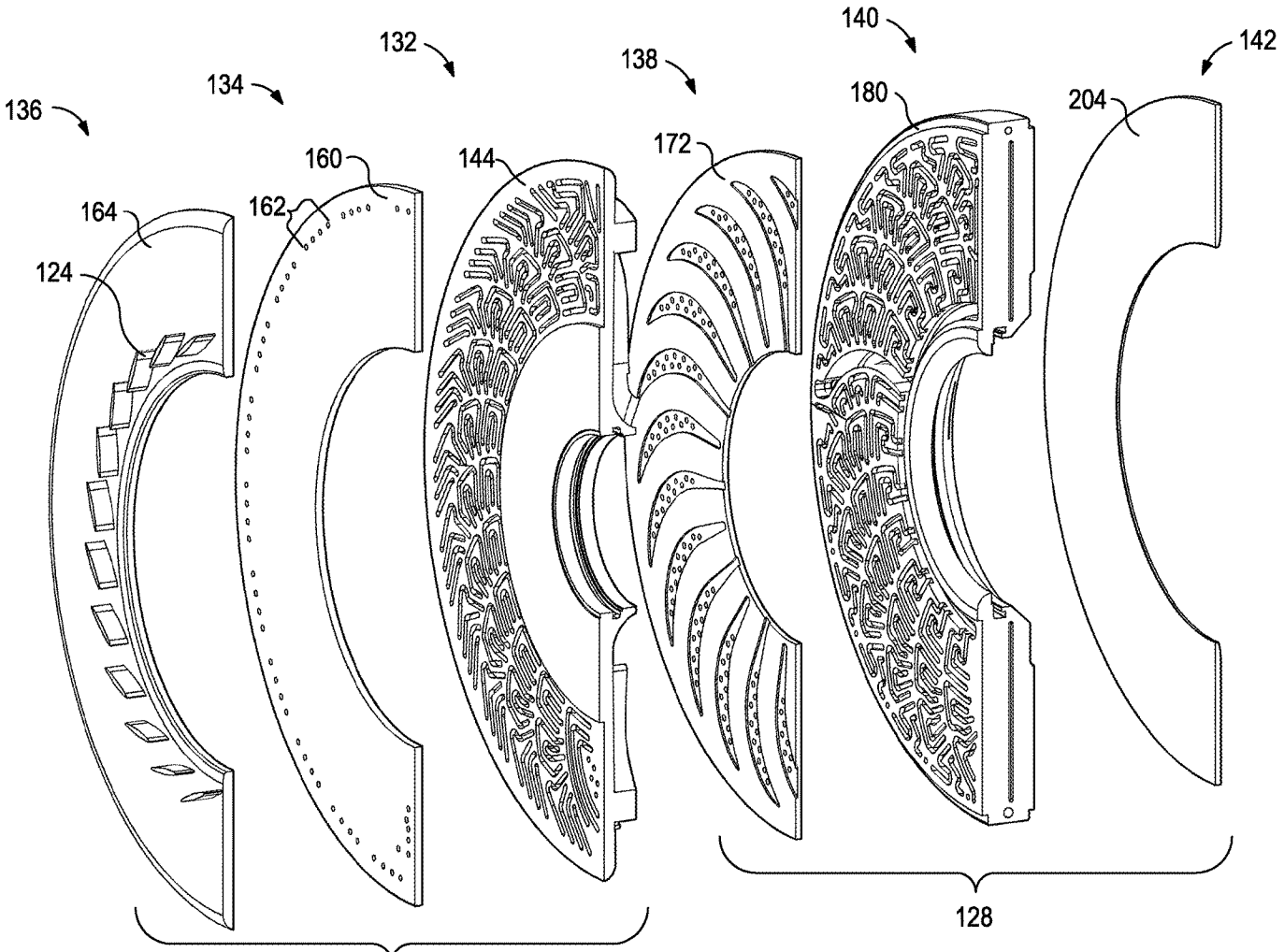
FIG. 3 illustrates an exploded view of the upstream facing side of an internally-cooled diaphragm, according to an embodiment.
Figure 4:
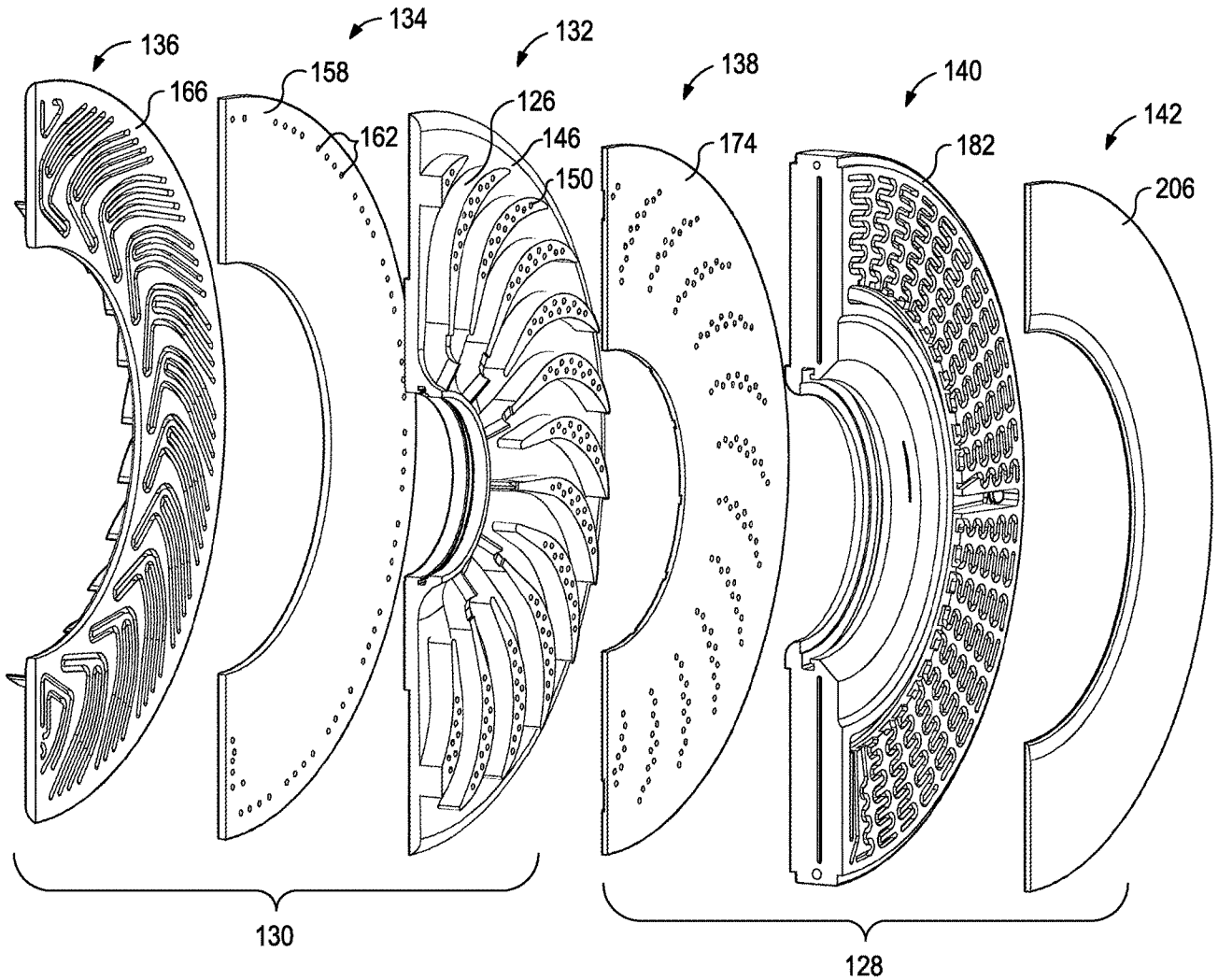
FIG. 4 illustrates an exploded view of the downstream facing side of the internally-cooled diaphragm of FIG. 3.

Referring now to FIGS. 3 and 4, exploded views of a front side and rear side, respectively, of a plurality of components 132,134,136,138,140,142 forming at least a portion of the diaphragm 102 are illustrated, according to an embodiment. More specifically, the plurality of components 132,134,136,138,140,142 may form the diaphragm box 128 and the bulb 130 of the diaphragm 102 as shown most clearly in FIG. 5. The plurality of components 132,134,136,138,140,142 in FIGS. 3-5 and shown in more detail in FIGS. 6*a*-11*b*, may be formed and configured based upon the centrifugal compressor 100 in which the diaphragm 102 may be disposed. Although the illustrated embodiment includes six components, one of ordinary skill in the art will appreciate that the number of components may vary depending, for example, on compressor characteristics, such as compressor size, flow rate of the working fluid, and/or flow rate of the cooling agent. For purposes of this disclosure, each component 132,134,136,138,140,142 may include a front side and a rear side, such that the front side of each component may be oriented to face the upstream side of the compressor 100. Correspondingly, the rear side of each component may be the opposing side of the front side and may be oriented to face the downstream side of the compressor 100.

Figure 5:
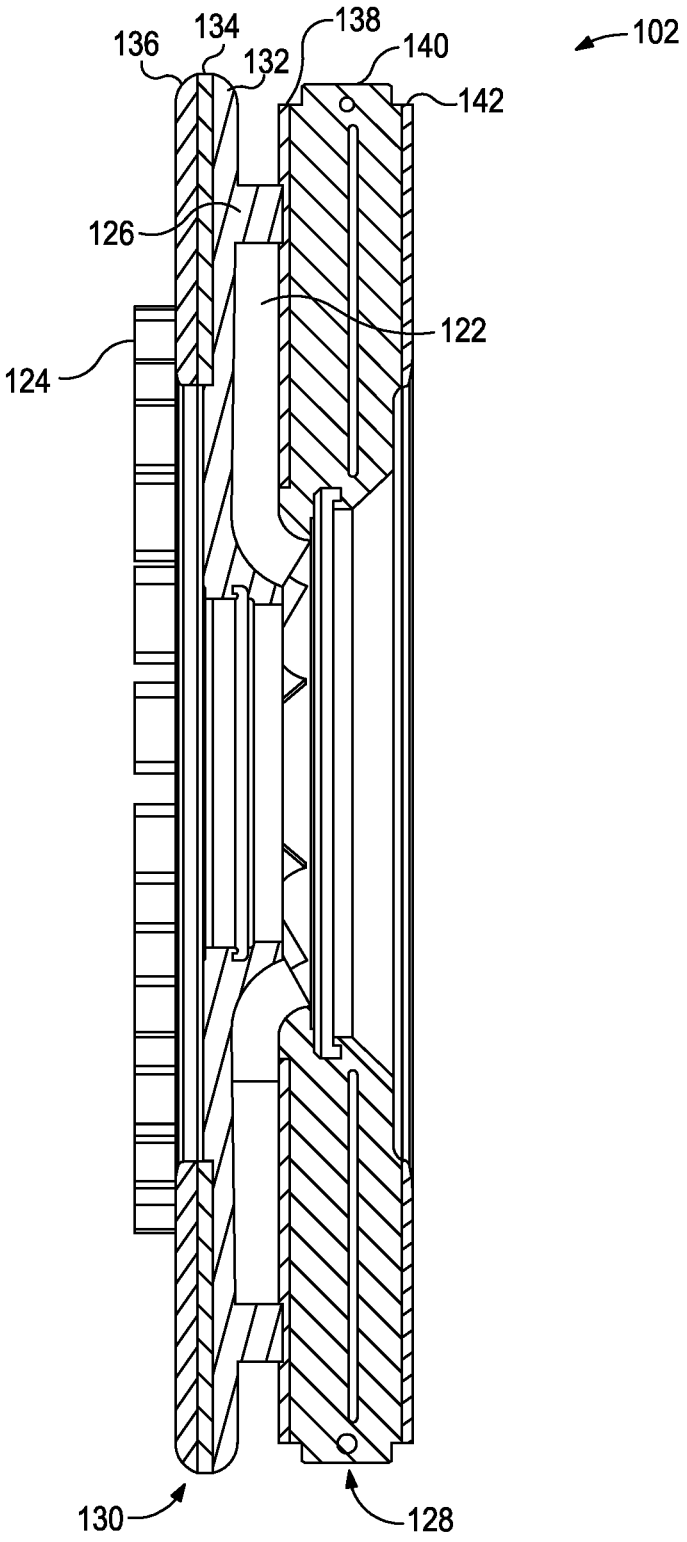
FIG. 5 illustrates a cross-sectional view of the internally-cooled diaphragm of FIGS. 3 and 4.

Moreover, the plurality of components 132,134,136,138,140,142 in FIGS. 3-5 and shown in more detail in FIGS. 6*a*-11*b*, form a plurality of levels 123*a-d*, or planes, defining a plurality of cooling passages forming in part the cooling pathway and being generally perpendicular to an axis A of the compressor 100 as shown in FIGS. 1 and 2. As oriented, the levels 123*a-d* may be parallel to the diffuser 120 and the return channel 122 and adjacent to each side of the flow passage of the diffuser 120 and return channel 122. In particular, the plurality of levels 123*a-d* may include a first cooling level 123*a* being adjacent to and in thermal communication with a shroud side of the return channel of the upstream stage (not shown), and a second cooling level 123*b* being adjacent to and in thermal communication with a hub side of the return channel of the upstream stage. The plurality of levels may further include a third cooling level 123*c* being adjacent to and in thermal communication with the hub side of the diffuser of the upstream stage, and a fourth cooling level 123*d* being adjacent to and in thermal communication with the shroud side of the diffuser of the downstream stage (not shown).

As will be further discussed below, the cooling agent may pass between the levels 123*a-d*, and in an exemplary embodiment, the components 132,134,136,138,140,142, through openings located in the return channel vanes 126, the box 128, or the bulb 130 as needed to create the desired cooling pathway. In an exemplary embodiment, the cooling pathway is configured to maximize the speed of the cooling agent therethrough, such that heat transfer is maximized for a given coolant flow rate needed to absorb the desired amount of energy from the gas. The cooling pathway may also be configured to create a counter-flow heat exchange configuration, such that temperature differential between the gas and the cooling agent at all points in the cooling pathway is maximized, thereby maximizing the overall rate of heat transfer. In a multistage, centrifugal compressor with cooled diaphragms, the coolest gas will be at the exit of the return channel of the upstream stage. The gas in the diffuser of the upstream stage will be warmer, and the gas in the diffuser of the downstream stage will be the warmest. Thus, the coolant agent may be routed such that the cooling agent may be exposed to these gas passages in corresponding sequence. It will be appreciated that given the wide array of potential applications of centrifugal compression technology, for which this disclosure is applicable, encompassing a diversity of gases, flow rates, operating pressures, and temperatures, the size of the cooled diaphragm, flow rate of fluid required, and therefore the quantity and arrangement of the passages, including the sequence of progression between the various cooling levels, may vary to achieve the intended purposes of the cooling pathway.

In an exemplary embodiment, the bulb 130 of the diaphragm 102 may be formed from at least some of the plurality of components, including the first bulb component 132, the second bulb component 134, and the third bulb component 136. As shown in FIGS. 3-5 and FIGS. 6*a* and 6*b*, the first bulb component 132 may include a front side 144 and an opposing rear side 146. The rear side 146 of the first bulb component 132, as shown in FIG. 6*b*, may form a plurality of return channel vanes 126 extending outwardly from a rear surface 148 of the rear side 146 and configured to redirect gas flow in the return channel 122. Each of the plurality of return channel vanes 126 defines a plurality of return vane conduits 150. Each of the return vane conduits 150 may be arranged and configured in the return channel vanes 126 such that the front side 144 and rear side 146 of the first bulb component 132 are in fluid communication via a portion of the cooling pathway formed by each of the plurality of return vane conduits 150.

Figure 6A:
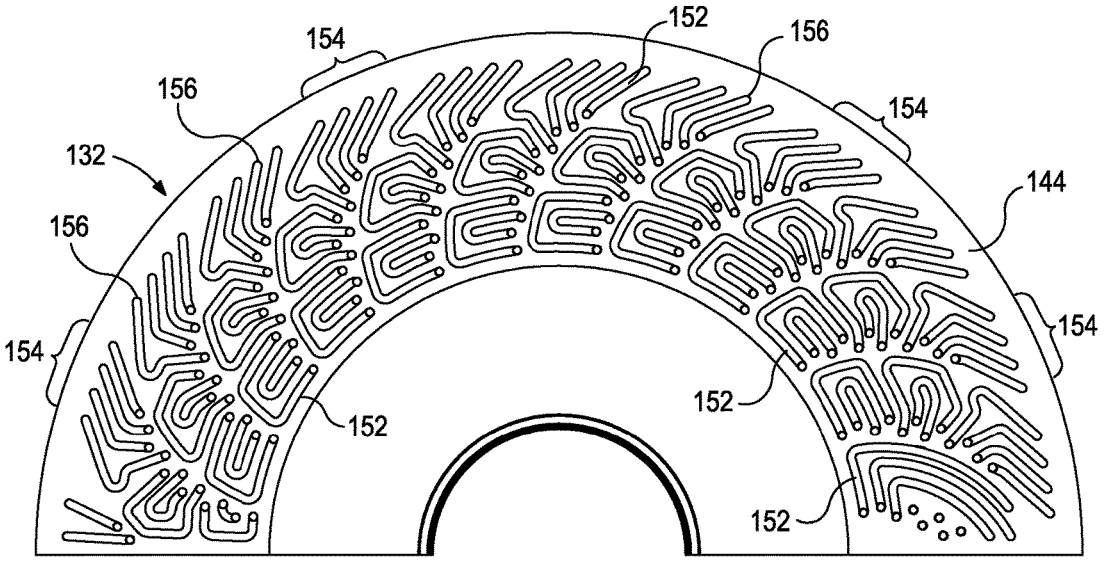
FIG. 6*a* illustrates a plan view of a front side of a first bulb component of the internally-cooled diaphragm of FIGS. 3-5.
Figure 6B:
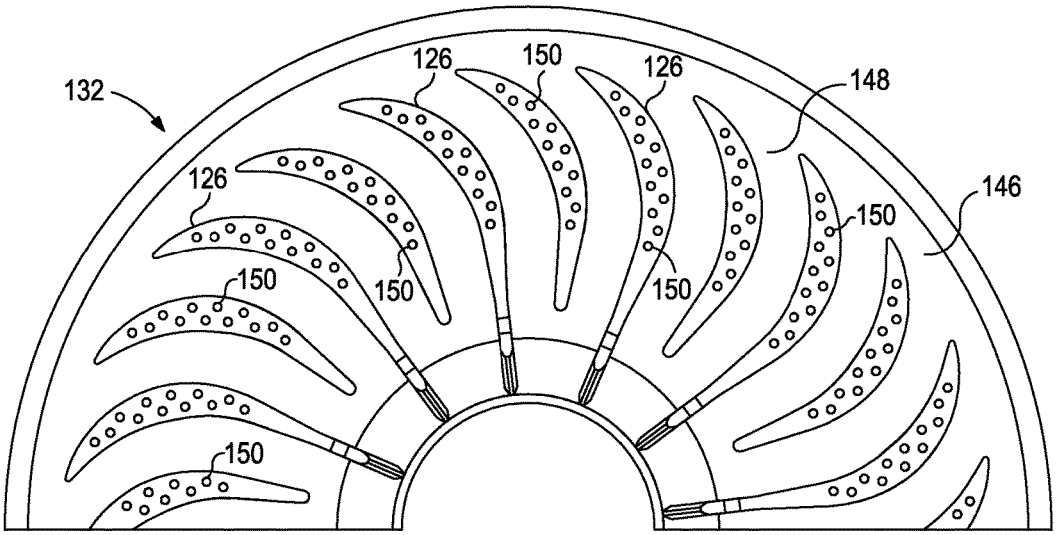
FIG. 6*b* illustrates a plan view of a rear side of the first bulb component of the internally-cooled diaphragm of FIGS. 3-5.
Figure 7A:
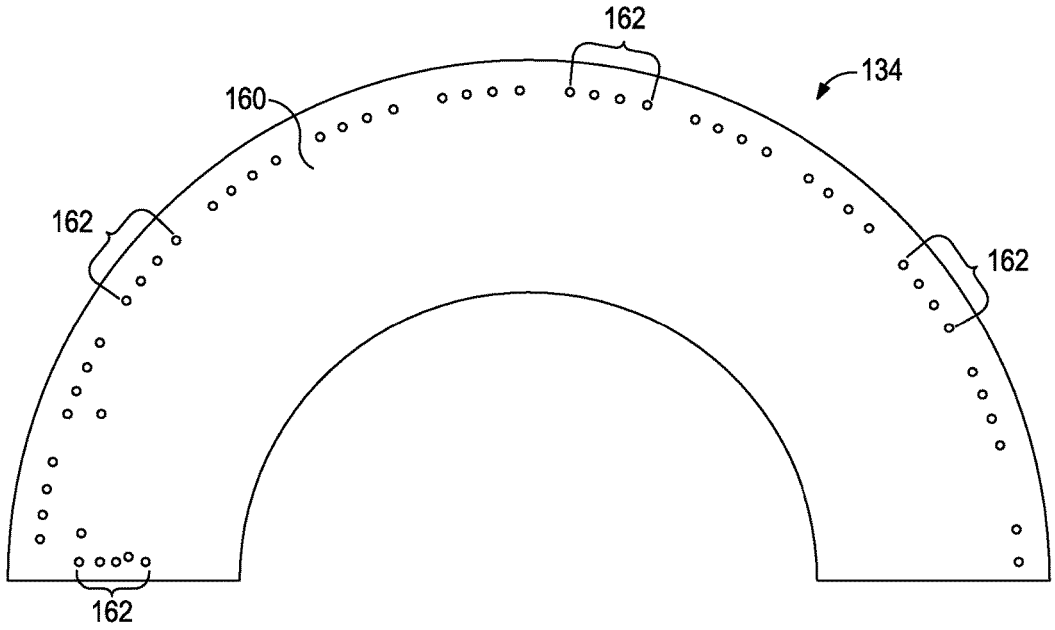
FIG. 7*a* illustrates a plan view of a front side of a second bulb component of the internally-cooled diaphragm of FIGS. 3-5.
Figure 7B:
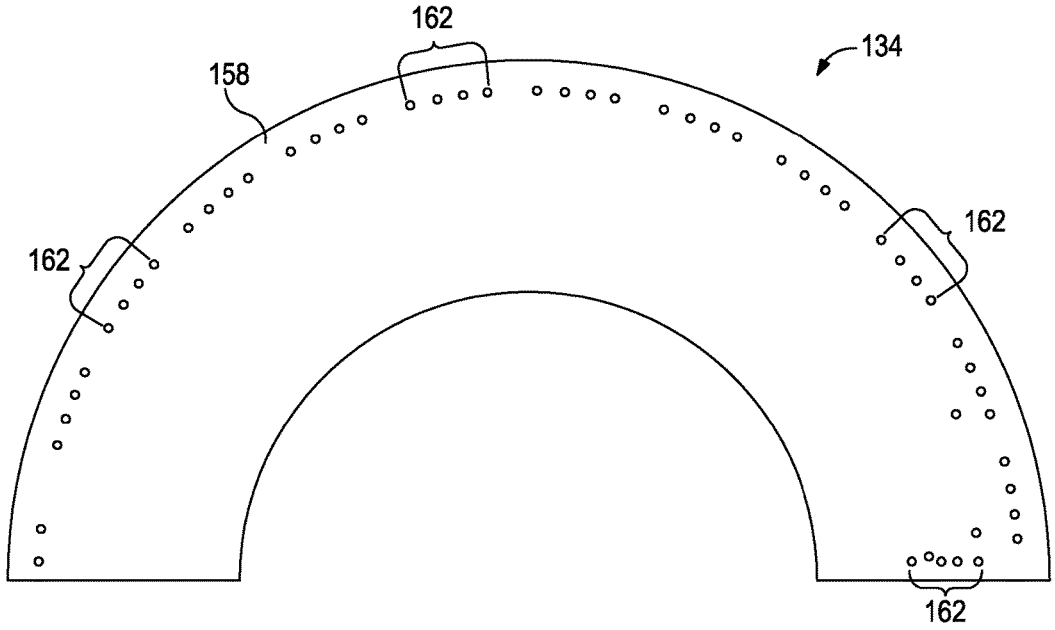
FIG. 7*b* illustrates a plan view of a rear side of the second bulb component of the internally-cooled diaphragm of FIGS. 3-5.

In an exemplary embodiment, the front side 144 of the first bulb component 132, as shown in FIG. 6*a*, defines a plurality of primary bulb channels 152, such that one or more primary bulb channels 152 are arranged in a plurality of return vane sections 154. Each return vane section 154 is formed on the front side 144 of the first bulb component 132 substantially opposite a respective return channel vane 126 formed on the rear side 146 of the first bulb component 132, and further defines the end portion of each of the plurality of return vane conduits 150 defined in the respective return channel vane 126. Each end of one or more of the primary bulb channels 152 disposed in a respective return vane section 154 is arranged to place a pair of return vane conduits 150 in fluid communication, thereby forming a portion of the cooling pathway. The first bulb component 132 further defines one or more primary bulb channels 152, each having an end arranged on the perimeter of the first bulb component 132, wherein one or more of the primary bulb channel ends 156 are proximate to a return vane section 154. Each of the primary bulb channel ends 156 is further arranged at the end of a primary bulb channel 152 of a respective return vane section 154, such that the primary bulb channel 152 and the primary bulb channel end 156 forms a portion of the cooling pathway.

The bulb 130 may be further formed by the second bulb component 134 illustrated in FIGS. 3-5 and FIGS. 7*a* and 7*b*. The second bulb component 134 includes a rear side 158, shown in FIG. 7*b*, and an opposing front side 160, shown in FIG. 7*a*, configured substantially similar to the rear side 158. The second bulb component 134 defines a plurality of perimeter openings or second bulb component openings 162 therethrough arranged on the perimeter of the second bulb component 134 and configured to form a portion of the cooling pathway. The plurality of second bulb component openings 162 are arranged on the perimeter of the second bulb component 134 in the same manner as the primary bulb channel ends 156 arranged on the perimeter of the first bulb component 132.

As shown in FIGS. 3-5 and FIGS. 8*a* and 8*b*, the bulb 130 may be further formed from the third bulb component 136 having a front side 164 and an opposing rear side 166. The front side 164 of the third bulb component 136, shown in FIG. 8*a*, may form the plurality of diffuser vanes 124. The diffuser vanes 124 may be configured on the bulb 130 such that the bulb 130, when disposed in the diffuser 120, provides for gas flowing from the impeller 112 in a radial direction to be redirected within the diffuser 120. The diffuser vanes 124 may be low solidity diffuser vanes in an exemplary embodiment, such that the diffuser vanes 124 extend a fixed distance radially along the bulb 130.

In another embodiment, the diffuser vanes 124 may further each form one or more diffuser vane conduits (not shown), such that the diffuser vane conduits are in fluid communication with the bulb 130 and configured to allow coolant flow therethrough. In an exemplary embodiment, the diffuser vane conduits may be formed in a U-shape having an inlet side section and an outlet side section such that coolant flow from a portion of the bulb 130 to each diffuser vane conduit may flow into the inlet side section and be returned to the portion of the bulb 130 via the outlet side section of the diffuser vane conduit.

Figure 8A:
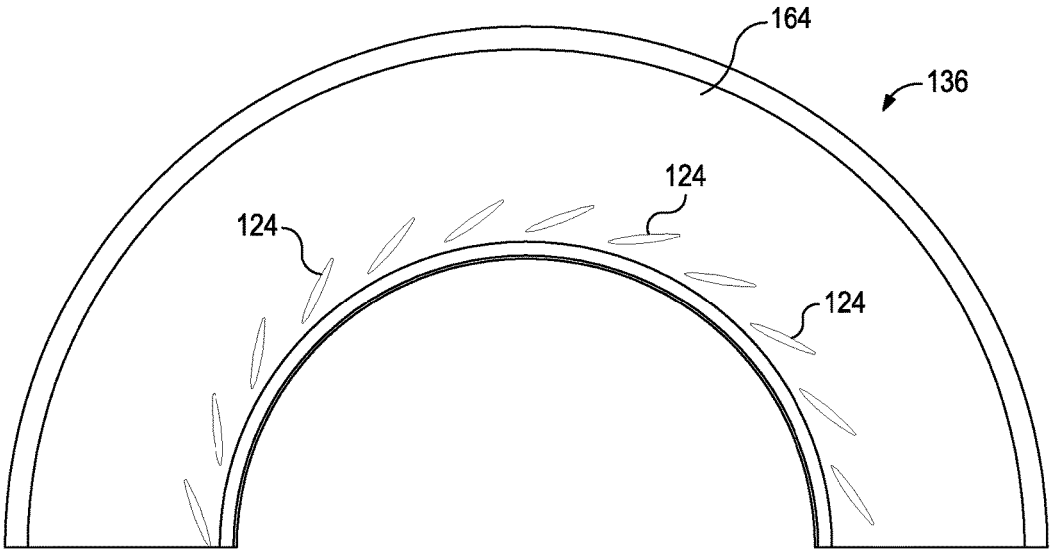
FIG. 8*a* illustrates a plan view of a front side of a third bulb component of the internally-cooled diaphragm of FIGS. 3-5.
Figure 8B:
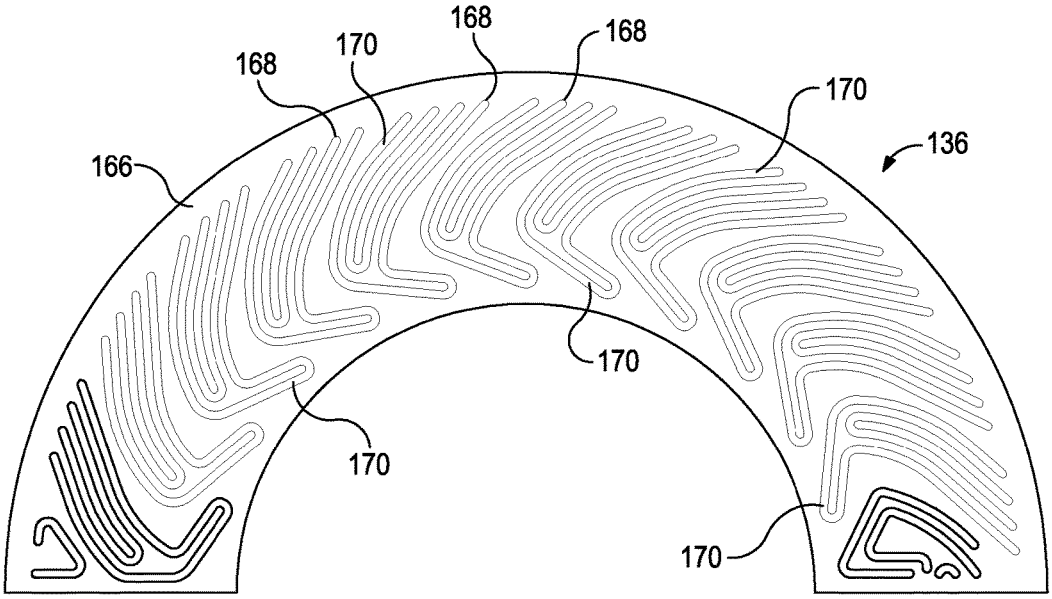
FIG. 8*b* illustrates a plan view of a rear side of the third bulb component of the internally-cooled diaphragm of FIGS. 3-5.

As shown in FIG. 8*b*, the rear side 166 of the third bulb component 136 defines a plurality of secondary bulb channels 170, such that one or more of the secondary bulb channels 170 at least partially surrounds the base of a respective diffuser vane 124 formed on the opposing front side 164. Each end 168 of the secondary bulb channel 170 may be arranged around the perimeter of the third bulb component 136 in the same manner as the plurality of second bulb component openings 162 may be arranged on the perimeter of the second bulb component 134. Each end 168 of the secondary bulb channel 170 may further be in fluid communication with a respective second bulb component opening 162 thereby forming a portion of the cooling pathway. The diffuser vanes 124 may be oriented such that each diffuser vane 124 may be transverse to a respective return channel vane 126; however, embodiments in which each diffuser vane 124 is oriented other than transverse to a respective channel vane 126 are contemplated herein.

Figure 9A:
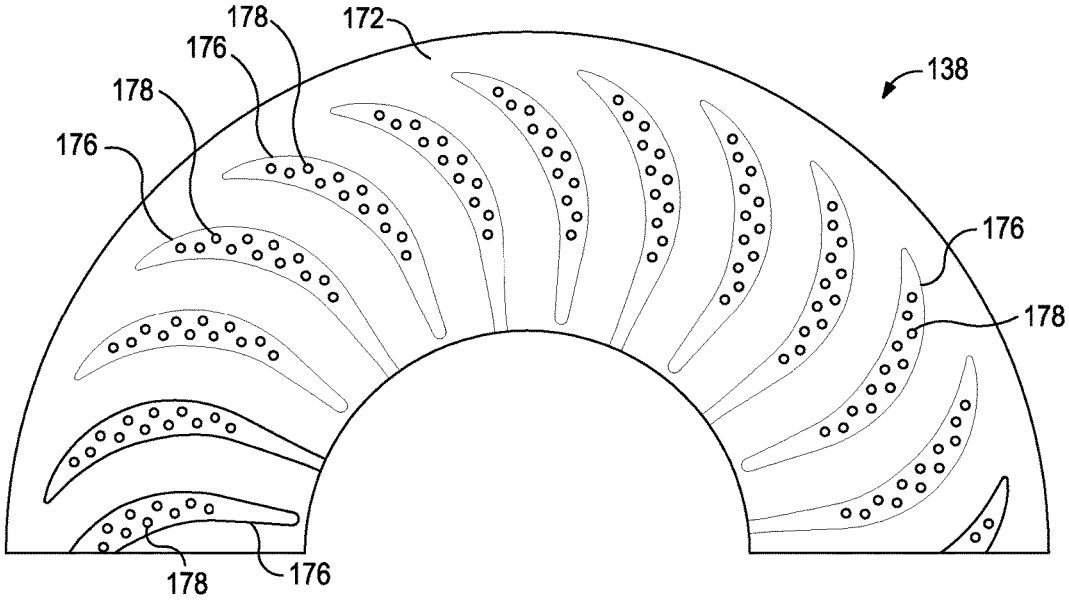
FIG. 9*a* illustrates a plan view of a front side of a first box component of the internally-cooled diaphragm of FIGS. 3-5.
Figure 9B:
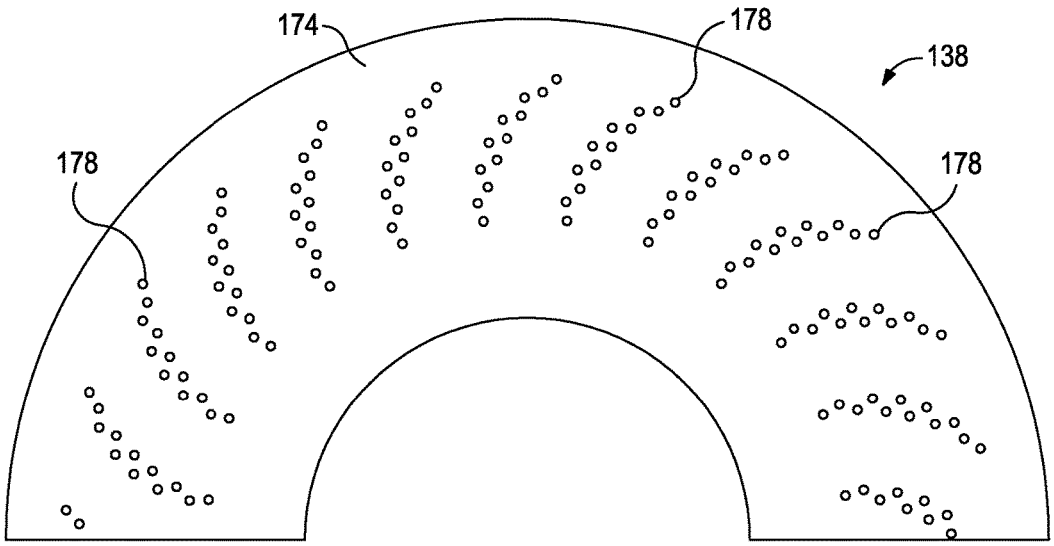
FIG. 9*b* illustrates a plan view of a rear side of the first box component of the internally-cooled diaphragm of FIGS. 3-5.

In an exemplary embodiment, the diaphragm box 128 of the diaphragm 102 may be formed from at least some of the plurality of components, including the first box component 138, the second box component 140, and the third box component 142. As shown in FIGS. 3-5 and FIGS. 9*a* and 9*b*, the first box component 138 may include a front side 172 and an opposing rear side 174. The front side 172 of the first box component 138 may be substantially planar, or as shown in FIG. 9*a*, may define a plurality of recesses 176, such that each recess 176 may be configured to receive a portion of a respective return channel vane 126 formed in the first bulb component 132. The first box component 138 may further define a plurality of first diaphragm box component openings, or recess openings 178, therethrough and in each recess 176, such that the plurality of recess openings 178 are arranged in each recess 176 in the same manner as the return vane conduits 150 formed in the respective return channel vane 126. Each recess opening 178 is further defined such that the second box component 140 may be in fluid communication with the return vane conduits 150 thereby forming a portion of the cooling pathway when the return channel vanes 126 are disposed in the respective recesses 176 of the first box component 138.

As shown in FIGS. 3-5 and FIGS. 10*a* and 10*b*, the diaphragm box 128 may be further formed from the second box component 140 having a front side 180 and an opposing rear side 182. The front side 180 of the second box component 140 may define an inlet fluid passageway 184 coupled in fluid communication to a supply line (not shown) configured to supply the cooling agent, or coolant, to the diaphragm 102. The front side 180 of the second box component 140 may further define a first semi-circular fluid passageway 186 extending around a portion of the rotary shaft 114 of the centrifugal compressor 100. The first semi-circular fluid passageway 186 may be intersected by the inlet fluid passageway 184 so that the inlet fluid passageway 184 and first semi-circular fluid passageway 186 may be in fluid communication and further form a portion of the cooling pathway.

Figure 10A:
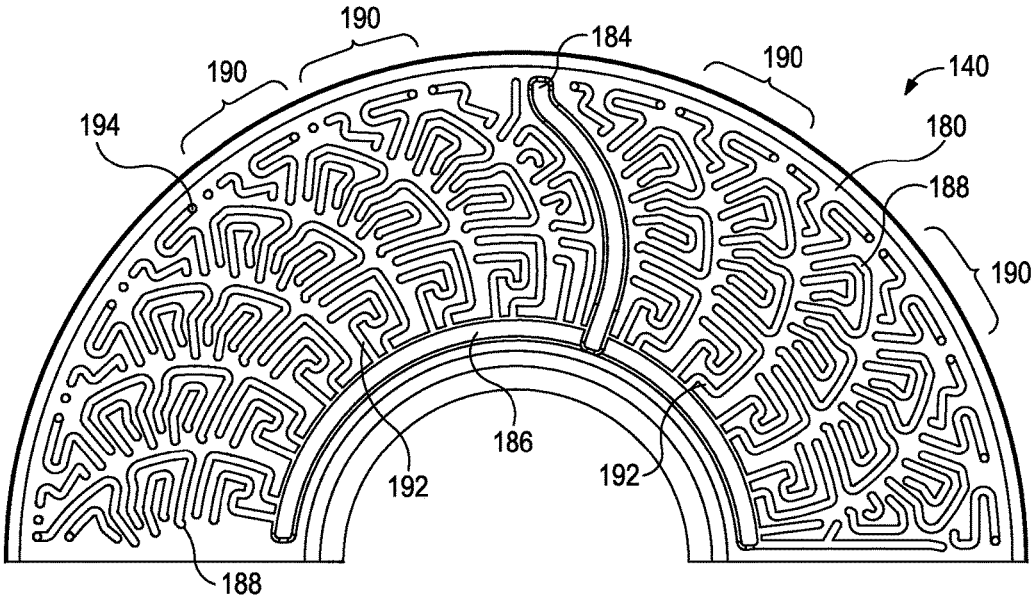
FIG. 10*a* illustrates a plan view of a front side of a second box component of the internally-cooled diaphragm of FIGS. 3-5.

The front side 180 of the second box component 140, as shown in FIG. 10*a*, further defines a plurality of primary box component channels 188 arranged in a plurality of primary box component channel sections 190. Each primary box component channel section 190 is arranged on the front side 180 of the second box component 140 to align with a respective recess 176 when the first box component 138 is disposed adjacent the second box component 140. One or more ends of the primary box component channels 188 may be arranged in the primary box component channel section 190 in the same manner as the return vane conduits 150 in a respective return channel vane 126, such that a pair of return vane conduits 150 and a primary box component channel 188 may form a portion of the cooling pathway when the diaphragm box 128 and bulb 130 are joined.

In each primary box component channel section 190, one or more of the return vane conduits 150 may be in fluid communication with the first semi-circular fluid passageway 186 via a respective first extension channel 192 thereby forming a portion of the cooling pathway. The second box component 140 further defines a plurality of perimeter openings or second box component apertures 194 arranged on the perimeter of the second box component 140, such that one or more of the second box component apertures 194 is proximate to a primary box component channel section 190. Each of the second box component apertures 194 is further arranged at the end of a primary box component channel 188 of a respective primary box component channel section 190, such that the primary box component channel 188 may be in fluid communication with the rear side 182 of the second box component 140 and the first box component 138 when the components are joined, thereby forming a portion of the cooling pathway.

Figure 10B:
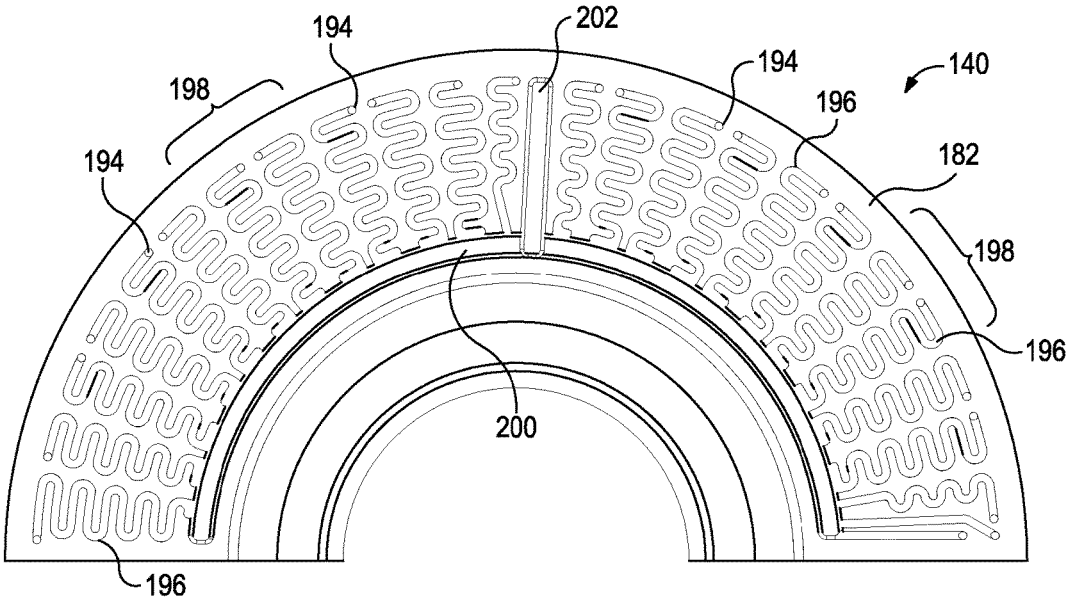
FIG. 10*b* illustrates a plan view of a rear side of the second box component of the internally-cooled diaphragm of FIGS. 3-5.
Figure 11A:
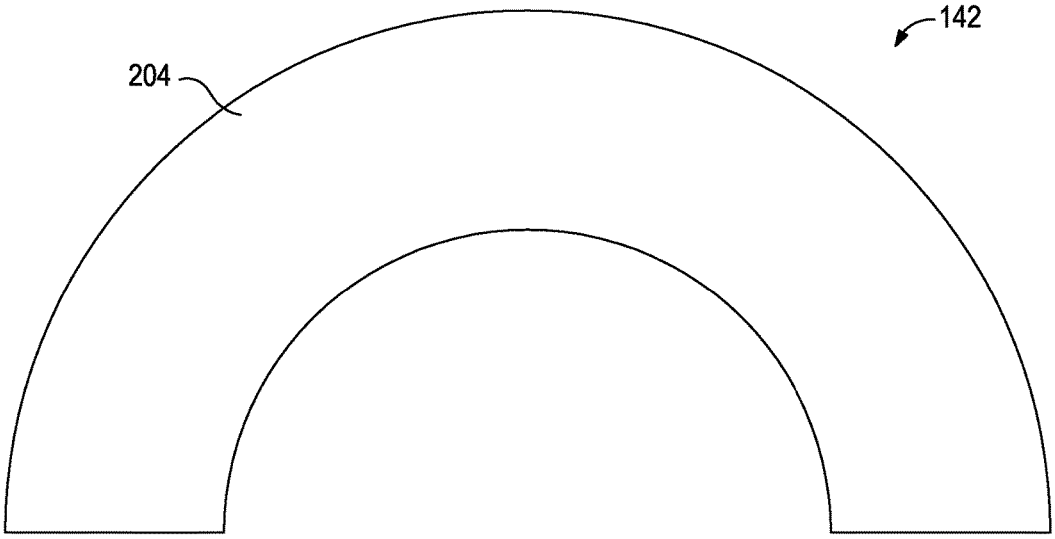
FIG. 11*a* illustrates a plan view of a front side of a third box component of the internally-cooled diaphragm of FIGS. 3-5.
Figure 11B:
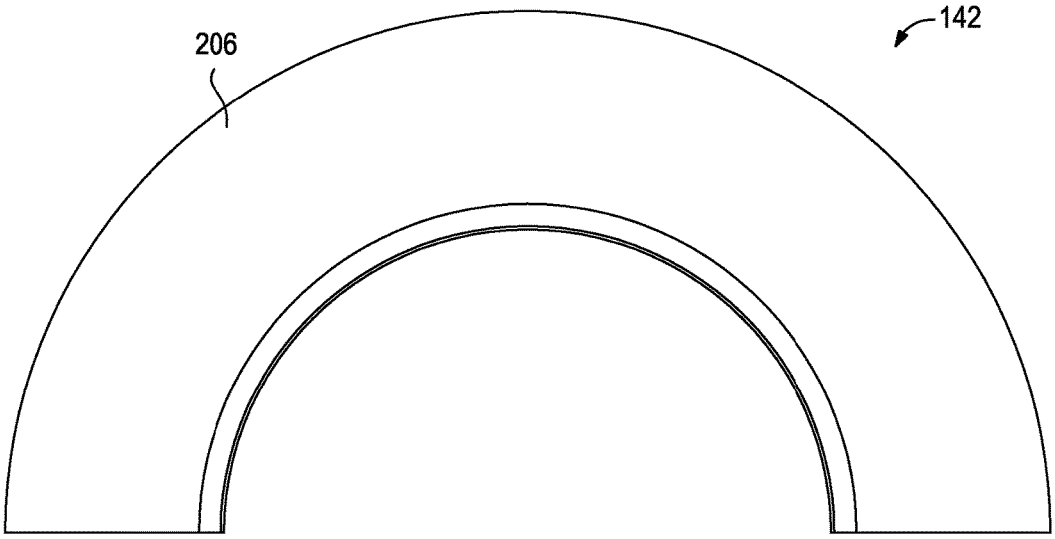
FIG. 11*b* illustrates a plan view of a rear side of the third box component of the internally-cooled diaphragm of FIGS. 3-5.

The rear side 182 of the second box component 140, as shown in FIG. 10*b*, may define a plurality of secondary box channels 196 arranged in a plurality of secondary box channel sections 198. Each secondary box channel 196 may be in fluid communication with a respective second box component aperture 194. Each secondary box channel section 198 may be arranged on the rear side 182 of the second box component 140 and may be in fluid communication with a second semi-circular fluid passageway 200 extending around a portion of the rotary shaft 114 of the centrifugal compressor 100 and defined by the rear side 182 of the second box component 140. The second semi-circular fluid passageway 200 may be intersected by an outlet fluid passageway 202 defined in the rear side 182 of the second box component 140, so that the outlet fluid passageway 202 and second semi-circular fluid passageway 200 are in fluid communication and form a portion of the cooling pathway. The outlet fluid passageway 202 may be coupled in fluid communication to a return line (not shown) configured to return a cooling agent to an external coolant source.

As shown in FIGS. 3-5 and FIGS. 11*a* and 11*b*, the diaphragm box 128 may be further formed by a third box component 142 including a front side 204 and an opposing rear side 206. In an exemplary embodiment, the third box component 142 may be configured such that the front side 204 may form a sealing relationship with the rear side 182 of the second box component 140.

In an exemplary embodiment, the components forming the diaphragm box 128 and bulb 130 may be fabricated by machining, such as by computer numerically controlled (CNC) milling techniques and may be formed from aluminum, steel, or other alloy. In another embodiment, one or more of the components may be cast by sand casting, plaster mold casting, investment casting, or die casting. One of ordinary skill in the art will appreciate that the components 132,134,136,138,140,142 may be aligned by any alignment method know in the art capable of substantially aligning each of the components for assembly.

In an exemplary embodiment, the diaphragm box 128, bulb 130, and the portion of the diaphragm 102 forming the diaphragm box 128 and bulb 130 may be formed by the process of brazing. The process of brazing may include interposing a brazing material between each of the plurality of diaphragm box components, each of the plurality of bulb components, and between the first bulb component 132 forming the plurality of return channel vanes 126 and the first box component 138 forming the plurality of recesses 176 configured and arranged to receive the portion of the plurality of return channel vanes 126. The braze material may include, but is not limited to, aluminum-silicon, copper, copper-phosphorous, copper-zinc, gold-silver, nickel alloy, silver, and combinations thereof. The components 132,134,136,138,140,142 may be pressed together and fed into a furnace (not shown) and heated to melt the brazing material, and then subsequently cooled, thereby joining the components 132,134,136,138,140,142 together to form the at least a section of the diaphragm of the internally-cooled compressor. It will be appreciated by one of ordinary skill in the art that the order of the brazing of the components 132,134,136,138,140,142 may be carried out such that various components may be heated in the furnace at a time, e.g., each of the components of the diaphragm box 128 and the bulb 130 may be heated in the furnace at the same time, or a component may be joined to only one other component at a time and heated in the furnace.

It will be appreciated, however, that other forms of manufacturing may be employed, without departing from the scope of the disclosure. For example, it is also contemplated to join the components 132,134,136,138,140,142 by diffusion bonding.

Turning now to the operation of the internally-cooled centrifugal compressor 100, an exemplary operation of an embodiment of the internally-cooled centrifugal compressor 100 will now be presented. In a conventional manner of operation, a working fluid is fed from a gas source into a compressor casing 110 through a stage inlet 106. The gas is drawn into a rotating impeller 112 driven by a rotating shaft 114 powered by an engine. In a conventional manner of operation, the velocity of the gas is increased by the impeller 112 and discharged through the impeller tips 116 into a diffuser 120, where the velocity energy of the gas is converted to pressure energy, thereby compressing the gas. The temperature of the gas increases as the gas is compressed. The compressed gas is forced into a return channel 122 from the diffuser 120 and ejected from the gas flow path via a stage outlet 108, and into a downstream processing component, or otherwise injected into a succeeding compressor stage.

Now turning to an exemplary embodiment, the gas may be cooled by the utilization of a centrifugal compressor 100 including the diaphragm 102 formed from the diaphragm box 128 and the bulb 130 being disposed within the compressor casing 110 as illustrated in FIGS. 1 and 2. As the gas is fed into the stage inlet 106 of the compressor casing 110, the cooling agent, or coolant, may be supplied from an external coolant source and may be fed via a supply line to a cooling pathway formed in the diaphragm 102 such that the heat may be transferred from the gas flowing through the gas flow path to the coolant flowing through the cooling pathway. The coolant having an increased temperature may flow from the diaphragm 102 via a return line to the external coolant source, where the coolant may be re-cooled and returned to the supply line.

More particularly, in an exemplary embodiment, the cooling pathway may be formed at least in part in the diaphragm 102 of the centrifugal compressor 100. The cooling pathway, in an exemplary embodiment may now be presented as the flow of the coolant through the diaphragm 102 as described herein. The coolant is fed from the external coolant source via the supply line to the diaphragm 102. The supply line may be coupled in fluid communication to the inlet fluid passageway 184 defined in the second box component 140 of the diaphragm box 128 of the diaphragm 102. The coolant may flow through the inlet fluid passageway 184 to the first semi-circular fluid passageway 186. The coolant in the first semi-circular fluid passageway 186 may be diverted such that a portion of the coolant may be fed into each of the first extension channels 192 coupled in fluid communication to the first semi-circular fluid passageway 186 of each primary box component channel section 190. The coolant may flow through the first extension channels 192 of each primary box component channel section 190 and into the recess opening 178 disposed adjacent the end of each first extension channel 192. The coolant may flow through the respective recess opening 178 of the first box component 138 and into a respective return vane conduit 150 in the first bulb component 132 of the bulb 130.

The coolant may be routed through the respective return vane conduit 150 into a primary bulb channel 152 and flowed to the paired return vane conduit 150 where the coolant is flowed back into the second box component 140 and through a primary box component channel 188. Such a flow of the coolant from the second box component 140 to the first bulb component 132 through a return vane conduit 150 and returning the coolant to the second box component 140 through another return vane conduit 150 may be referred to as a pass. In an exemplary embodiment, the diaphragm 102 may include a plurality of passes. In another embodiment, the diaphragm 102 may include six passes. Those of ordinary skill in the art will appreciate that the number of passes in the diaphragm 102 may vary and may be based, for example, on the type and size of the centrifugal compressor 100 utilized.

The coolant may be passed between the second box component 140 and the first bulb component 132 via the primary box component channels 188 and the return vane conduits 150 depending on the number of return vane conduits 150 defined by each of the return channel vanes 126. As the coolant is passed through the last return vane conduit 150 forming a pass in each return channel vane 126 and into the first bulb component 132, the coolant is flowed through the primary bulb channel 152 to a respective primary bulb channel end 156. The coolant may be flowed through the respective primary bulb channel end 156, the respective second bulb component opening 162 defined by the second bulb component 134 and through the respective secondary bulb channel end 168 defined by the third bulb component 142.

The coolant flowing through the secondary bulb channel end 168 may be routed through a respective secondary bulb channel 170, such that one or more of the secondary bulb channels 170 forming a portion of the cooling pathway at least partially encompass the base of a respective diffuser vane 124. The coolant returns through another paired secondary bulb channel end 168 disposed at the other end of the respective secondary bulb channel 170 and flows back into the first bulb component 132 and into a respective primary bulb channel 152. The coolant flows from the respective primary bulb channel 152 into a respective vane conduit 150 and out through a primary box component channel 188 and into a respective second box component aperture 194 such that the coolant flows through the second box component 140 to the rear side 182 of the second box component 140.

The coolant may be fed from the respective second box component aperture 194 in the rear side 182 into a respective secondary box channel 196 being in fluid communication and forming a portion of the cooling pathway with the respective second box component aperture 194. The coolant may be flowed into a second semi-circular fluid passageway 200 in fluid communication with the respective secondary box channel 196 and extending around a portion of the rotary shaft 114 of the centrifugal compressor 100 and defined by the rear side 182 of the second box component 140. The second semi-circular fluid passageway 200 may be intersected by an outlet fluid passageway 202 defined in the rear side 182 of the second box component 140, so that the outlet fluid passageway 202 and second semi-circular fluid passageway 200 are in fluid communication and form a portion of the cooling pathway. The coolant may flow through the second semi-circular passageway 200 and the outlet fluid passageway 202 and into a return line being coupled in fluid communication with the outlet fluid passageway 202. The return line may be configured to return the coolant to an external coolant source.

In an embodiment, the coolant source may be one or more components capable of transferring heat from the cooling agent. For example, the cooling source may be a closed circuit type, in which heat is removed either to the ambient air via an air cooled heat exchanger or to a secondary cooling fluid via a secondary heat exchanger. The secondary cooling fluid may be water with or without glycol added, refrigerants, synthetic heat transfer fluids, or the like. In another embodiment, the cooling source may be a circulating water system, in which heat is rejected to the ambient air in a direct evaporative process, i.e., a cooling tower. In an exemplary embodiment, the coolant source includes one or heat exchangers (not shown). In an embodiment, the cooling agent may be circulated and reconditioned by one or more of the heat exchangers before being reintroduced into the inlet fluid passageway 184 of the diaphragm box 128.

In one or more embodiments, the cooling agent may be any suitable heat transfer fluid, such as an HCFC, water, ethylene glycol, or the like. In some embodiments, a portion of the working fluid may be bled off, from the flowpath, either upstream or downstream from the compressor 100, conditioned and used for the cooling agent. In other embodiments, seal gas, bearing cooling fluid, or any other suitable system stream may be employed as the cooling agent. Further, it will be appreciated by one of ordinary skill in the art that the cooling agent may be a liquid, a gas, or a combination thereof.

The present disclosure is not limited to a particular configuration of the diaphragm 102, e.g., the number of components or channels, and/or the particular components forming the diffuser vanes 124, return channel vanes 126, component channels or apertures/openings. Instead, the current disclosure encompasses unique and novel aspects relating to the efficient operation of a compressor 100 where internal cooling is provided by maximizing the surface area of the cooling pathway of the diaphragm 102 inside the compressor 100 without negatively impacting gas pressure. Consequently, various features can be utilized within the diaphragm 102 to improve efficiency and avoid negative impacts on the performance of the compressor 100.

Figure 12:
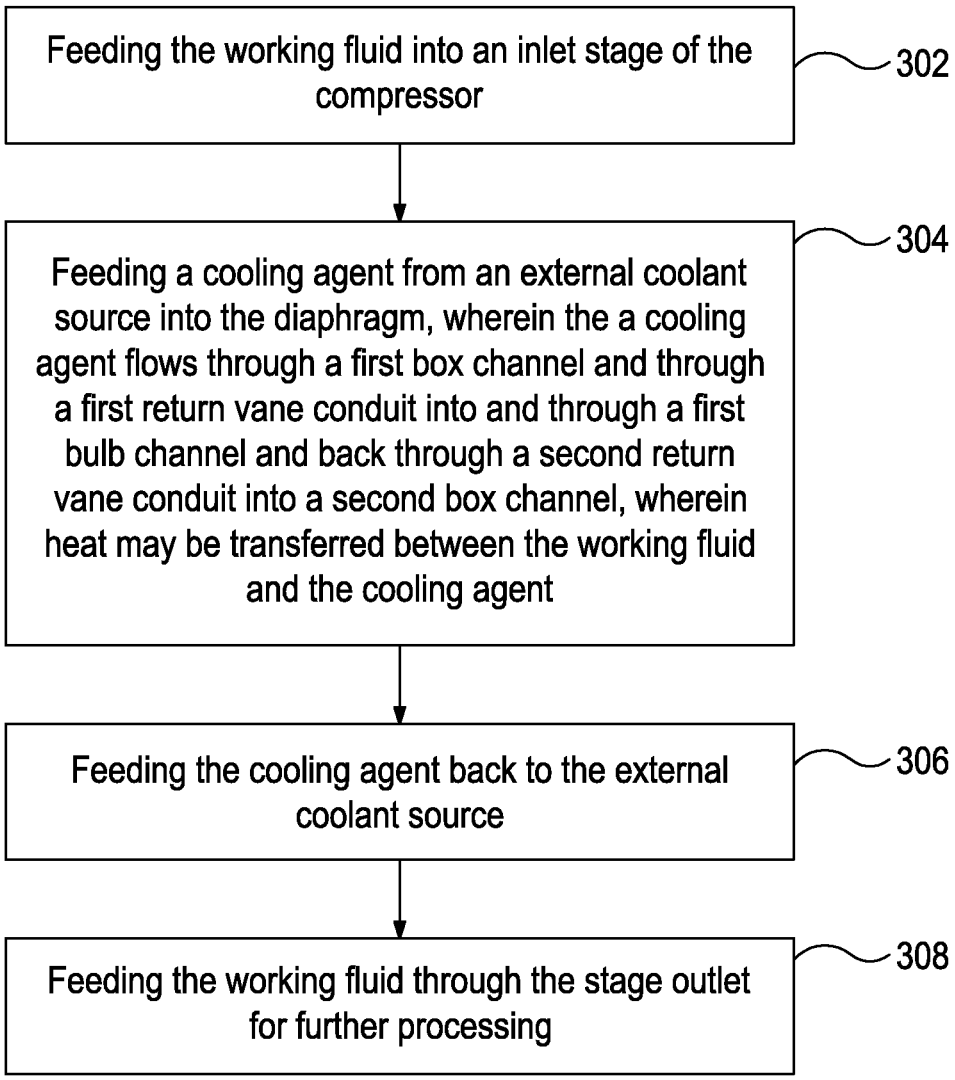
FIG. 12 is a flowchart of a method for cooling a working fluid flowing through a centrifugal compressor, according to an embodiment.

FIG. 12 illustrates a flowchart of a method 300 for cooling a working fluid in a compressor. In an exemplary embodiment, the method 300 may include feeding the working fluid into an inlet stage of the compressor, as at 302. The compressor may include a casing defining the stage inlet and a stage outlet, and a diaphragm disposed in the casing.

The diaphragm may include a diaphragm box formed from a plurality of box components, such that one or more of the plurality of box components defines a plurality of box channels. The diaphragm may also include a bulb formed from a plurality of bulb components, such that one or more of the plurality of bulb components defines a plurality of bulb channels. The diaphragm may further include a plurality of return channel vanes connecting the diaphragm box and bulb in fluid communication, such that each of the plurality of return channel vanes defines a plurality of return vane conduits coupled in fluid communication with the plurality of box channels and the plurality of bulb channels thereby forming a first section of a cooling pathway.

The method 300 may also include feeding a cooling agent from an external coolant source into the diaphragm, such that the cooling agent flows through a first box channel and through a first return vane conduit into and through a first bulb channel and back through a second return vane conduit into a second box channel, such that heat may be transferred between the working fluid and the cooling agent, as at 304. The method may further include feeding the cooling agent back to the external coolant source, as at 306, and feeding the working fluid through the stage outlet for further processing, as at 308.

Figure 13:
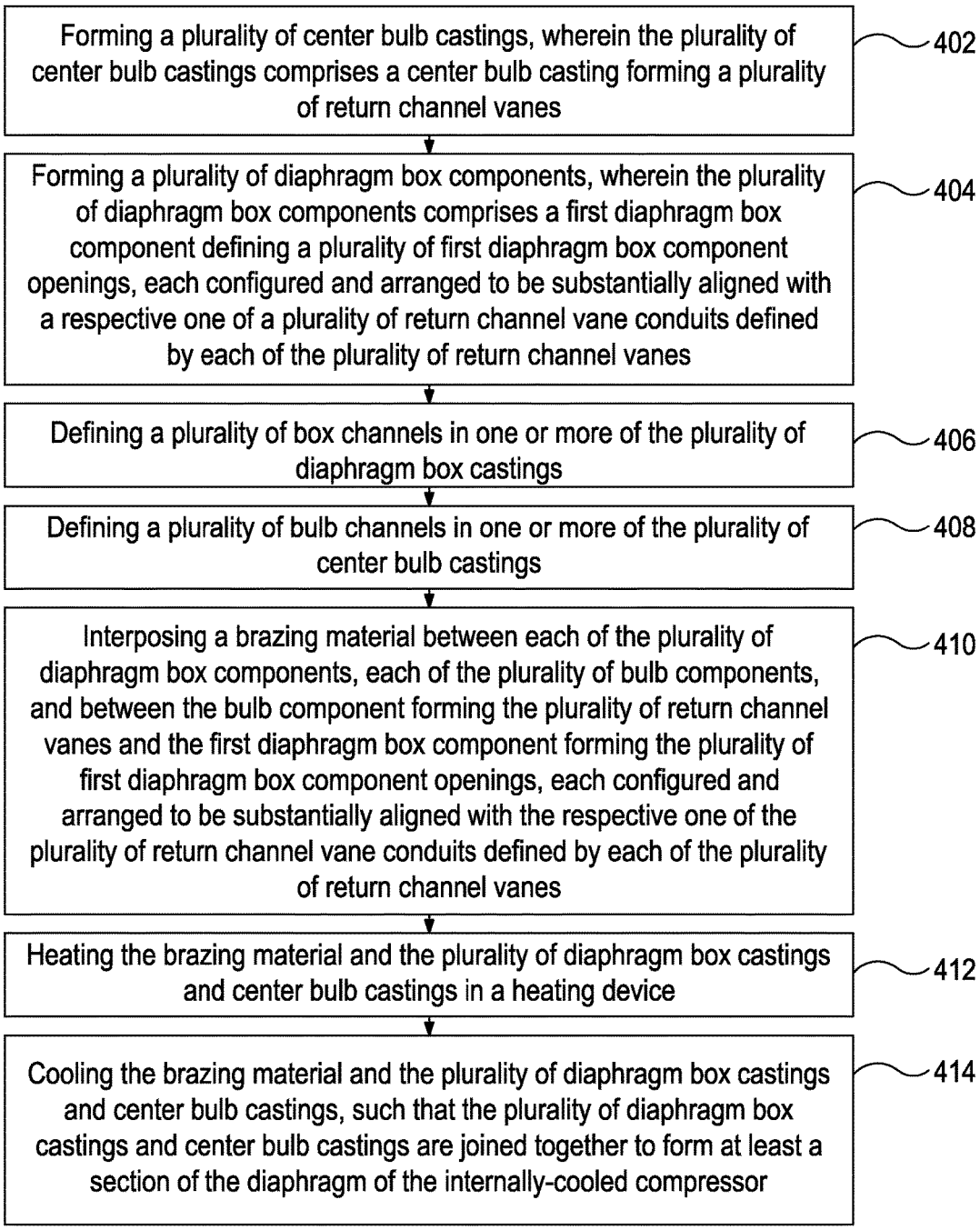
FIG. 13 is a flowchart of a method for manufacturing an internally-cooled centrifugal compressor, according to an embodiment.

FIG. 13 illustrates a flowchart of a method 400 for manufacturing at least a section of an internally-cooled diaphragm of a centrifugal compressor. In an exemplary embodiment, the method 400 may include forming a plurality of bulb components, such that the plurality of bulb components includes a bulb component forming a plurality of return channel vanes, as at 402. The method 400 may also include forming a plurality of diaphragm box components, such that the plurality of diaphragm box components includes a first diaphragm box component defining a plurality of first diaphragm box component openings, each configured and arranged to be substantially aligned with a respective one of a plurality of return channel vane conduits defined by each of the plurality of return channel vanes, as at 404.

The method 400 may further include defining a plurality of box channels in one or more of the plurality of diaphragm box components, as at 406, and defining a plurality of bulb channels in one or more of the plurality of bulb components, as at 408. The method may also include interposing a brazing material between each of the plurality of diaphragm box components, each of the plurality of bulb components, and between the bulb component forming the plurality of return channel vanes and the first diaphragm box component forming the plurality of first diaphragm box component openings, each configured and arranged to be substantially aligned with the respective one of the plurality of return channel vane conduits defined by each of the plurality of return channel vanes, as at 410.

The method may further include heating the brazing material and the plurality of diaphragm box components and bulb components in a heating device, as at 412, and cooling the brazing material and the plurality of diaphragm box components and bulb components, such that the plurality of diaphragm box components and bulb components are joined together to form at least the section of the diaphragm of the internally-cooled compressor, as at 414.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. An internally-cooled compressor comprising:

a casing defining at least in part a stage inlet and a stage outlet; and a diaphragm disposed in the casing and comprising:

a diaphragm box formed from a plurality of box components, wherein one or more of the plurality of box components defines a plurality of box channels;

a bulb formed from a plurality of bulb components, wherein a bulb component of the plurality of bulb components defines a plurality of primary bulb channels, and a second bulb component of the plurality of bulb components defines a plurality of secondary bulb openings around and proximate to the perimeter of the second bulb component; and a plurality of return channel vanes extending from the first bulb component and connecting the diaphragm box and bulb in fluid communication, wherein each of the plurality of return channel vanes defines a plurality of return vane conduits coupled in fluid communication with the plurality of box channels and the plurality of bulb channels, thereby forming a first section of a cooling pathway, wherein the cooling pathway is configured such that a cooling agent introduced from an external coolant source into the diaphragm box and flowing through a first box channel flows through a first return vane conduit into and through a first bulb channel and back through a second return vane conduit into a second box channel before flowing back to the external coolant source.

2. The internally-cooled compressor of claim 1, wherein the diaphragm box includes a brazing material between at least two of the plurality of box components.

3. The internally-cooled compressor of claim 1, wherein the bulb includes a brazing material between at least two of the plurality of bulb components.

4. The internally-cooled compressor of claim 1, wherein a third bulb component of the plurality of bulb component forms one or more diffuser vanes, and one or more of the plurality of the tertiary bulb channels is defined proximate to a base section of said diffuser vanes.

5. The internally-cooled compressor of claim 1, wherein the cooling pathway comprises:

an inlet fluid passageway and a first semi-circular fluid passageway defined in a front side of a box component of the plurality of box components; and an outlet fluid passageway and a second semi-circular fluid passageway defined in a rear side of the box component.

6. The internally-cooled compressor of claim 1, wherein the cooling agent comprises water, ethylene glycol, or a combination thereof.

7. The internally-cooled compressor of claim 1, wherein a plurality of openings is defined in the diaphragm box and arranged around and proximate to the perimeter of the diaphragm box, thereby forming a second section of the cooling pathway.

8. A method for cooling a working fluid in a compressor, comprising:

feeding the working fluid into an inlet stage of the compressor, the compressor comprising:

a casing defining at least in part the stage inlet and a stage outlet; and a diaphragm disposed in the casing and comprising:

a diaphragm box formed from a plurality of box components, wherein one or more of the plurality of box components defines a plurality of box channels;

a bulb formed from a plurality of bulb components, wherein a bulb component of the plurality of bulb components defines a plurality of primary bulb channels, and a second bulb component of the plurality of bulb components defines a plurality of secondary bulb openings around and proximate to the perimeter of the second bulb component; and a plurality of return channel vanes extending from the first bulb component and connecting the diaphragm box and bulb in fluid communication, wherein each of the plurality of return channel vanes defines a plurality of return vane conduits coupled in fluid communication with the plurality of box channels and the plurality of bulb channels thereby forming a first section of a cooling pathway;

feeding a cooling agent from an external coolant source into the diaphragm, wherein the cooling agent flows through a first box channel and through a first return vane conduit into and through a first bulb channel and back through a second return vane conduit into a second box channel, wherein heat is transferred between the working fluid and the cooling agent;

feeding the cooling agent back to the external coolant source; and feeding the working fluid through the stage outlet for further processing.

9. The method of claim 8, further comprising brazing at least two of the plurality of box components to form the diaphragm box.

10. The method of claim 8, wherein the cooling agent comprises water, ethylene glycol, or combinations thereof.

11. The method of claim 8, further comprising brazing at least two of the plurality of bulb components to form the bulb.

12. The method of claim 8, wherein a bulb component of the plurality of bulb components forms one or more low-solidity diffuser vanes.

13. A method for manufacturing at least one section of a diaphragm for an internally-cooled compressor, comprising:

forming a plurality of bulb components, wherein the plurality of bulb components comprises a first bulb component forming a plurality of return channel vanes and a second bulb component;

forming a plurality of diaphragm box components, wherein the plurality of diaphragm box components comprises a first diaphragm box component defining a plurality of first diaphragm box component openings, each configured and arranged to be substantially aligned with a respective one of a plurality of return channel vane conduits defined by each of the plurality of return channel vanes;

defining a plurality of box channels in one or more of the plurality of diaphragm box components;

defining a plurality of primary bulb channels in the first bulb component;

defining a plurality of secondary bulb openings around and proximate to the perimeter of the second bulb component;

interposing a brazing material between each of the plurality of diaphragm box components, each of the plurality of bulb components, and between the bulb component forming the plurality of return channel vanes and the first diaphragm box component forming the plurality of first diaphragm box component openings;

heating the brazing material and the plurality of diaphragm box components and bulb components in a heating device; and cooling the brazing material and the plurality of diaphragm box components and bulb components, such that the plurality of diaphragm box components and bulb components are joined together to form the at least one section of the diaphragm of the internally-cooled compressor.

14. The method of claim 13, further comprising defining an inlet fluid passageway and an outlet fluid passageway in a second diaphragm box component of the plurality of diaphragm box components, the inlet fluid passageway configured to be in fluid communication with an external coolant source via a supply line and the outlet fluid passageway and configured to be in fluid communication with the external coolant source via a return line.

15. The method of claim 13, wherein at least one of the plurality of bulb components and/or at least one of the plurality of diaphragm box components are formed by casting.

16. The method of claim 13, wherein at least one of the plurality of bulb components and/or at least one of the plurality of diaphragm box components are formed by machining.

17. The method of claim 13, wherein the plurality of bulb components comprises a third bulb component forming a plurality of diffuser vanes.

18. The method of claim 13, wherein the first diaphragm box component defines a plurality of recesses, each recess configured to receive a portion of a respective one of the plurality of return channel vanes.

19. The method of claim 13, further comprising defining a plurality of perimeter openings around and proximate to the perimeter of one or more of the diaphragm box components of the plurality of diaphragm box components.

* * * * *